United States Patent [19]

Volcjak

[11] 4,401,143

[45] Aug. 30, 1983

[54] LOG SPLITTING DEVICES

[76] Inventor: Richard P. Volcjak, Coulter Brook Rd., Bovina, N.Y. 13740

[21] Appl. No.: 275,646

[22] Filed: Jun. 22, 1981

[51] Int. Cl.[3] ..... B27L 7/00

[52] U.S. Cl. ..... 144/193 E; 144/193 R; 254/104

[58] Field of Search ..... 144/193 R, 193 A, 193 C, 144/193 D, 193 E; 254/104; 145/1 R; 125/23 R

[56] References Cited

U.S. PATENT DOCUMENTS

| | | | |
|---|---|---|---|
| 3,515,372 | 6/1970 | Courville | 254/104 X |
| 3,974,867 | 8/1976 | Butas | 144/193 A |
| 4,102,373 | 7/1978 | Winiasz | 144/193 A |
| 4,153,088 | 5/1979 | King et al. | 144/193 A |
| 4,209,046 | 6/1980 | Lavigne | 144/193 D |

*Primary Examiner*—W. D. Bray

[57] ABSTRACT

An attachment for single fixed wedge log splitters that quarters half logs consists of a base plate with an opening in it to allow the attachment to slide down over the fixed wedge of the splitter. Extending from each longitudinal side of the opening is a blade which forms an acute angle to the horizontal.

5 Claims, 4 Drawing Figures

LOG SPLITTING DEVICES

BACKGROUND OF THE INVENTION

This invention relates generally to log splitting devices and more particularly to power log splitters.

Power log splitters can be broken up into two general catagories. The first type splits a given log or piece of wood into two pieces with each cycle of the device. The second type splits a given log or piece of wood into more than two pieces with each cycle of the device. The former type has a single blade or wedge either permanently or semi-permanently fixed to the device. U.S. Pat. No. 4,157,105 by B. J. Gansley is one example of such a splitter.

A disadvantage of such splitters is that, for each cycle of the device, they only split a given piece of wood into two pieces. I have observed while using these types of single fixed wedge splitters that after the log is initially split in half, subsequent splitting of the pieces is done by the splitter with a greater deal less effort.

SUMMARY

It is the object of this invention to disclose an attachment for single fixed wedge power log splitters that quarters a previously split log.

A log is split in half in the usual manner with the attachment removed. The attachment is then slid down over the fixed wedge of the splitter. Each previously split half is then pushed through the splitter and split into four pieces. In this way, eight pieces are obtained from a larger size log in three passes. Thus, a considerable time saving is achieved with a single fixed wedge splitter in an inexpensive way that is easy to handle. This attachment significantly improves efficiency at a very modest cost.

DESCRIPTION OF THE PREFERRED EMBODIMENT

Figure 1:
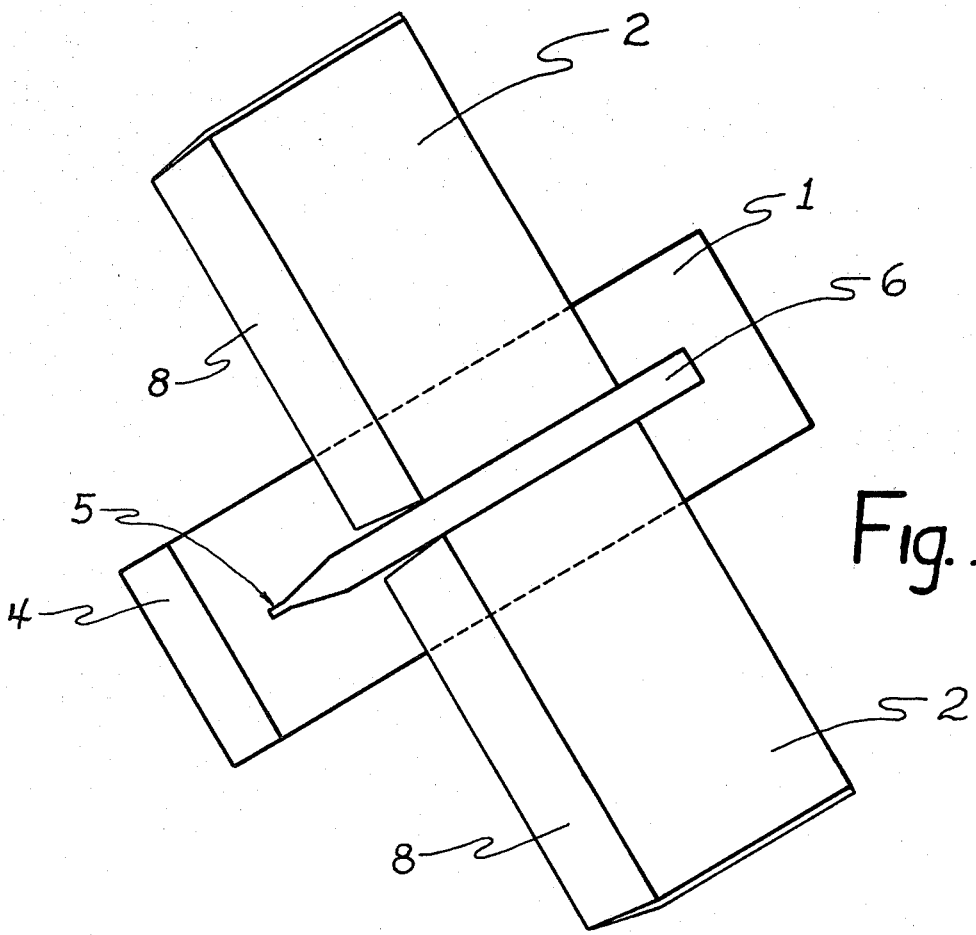
FIG. 1 is a top view of the attachment.
Figure 2:
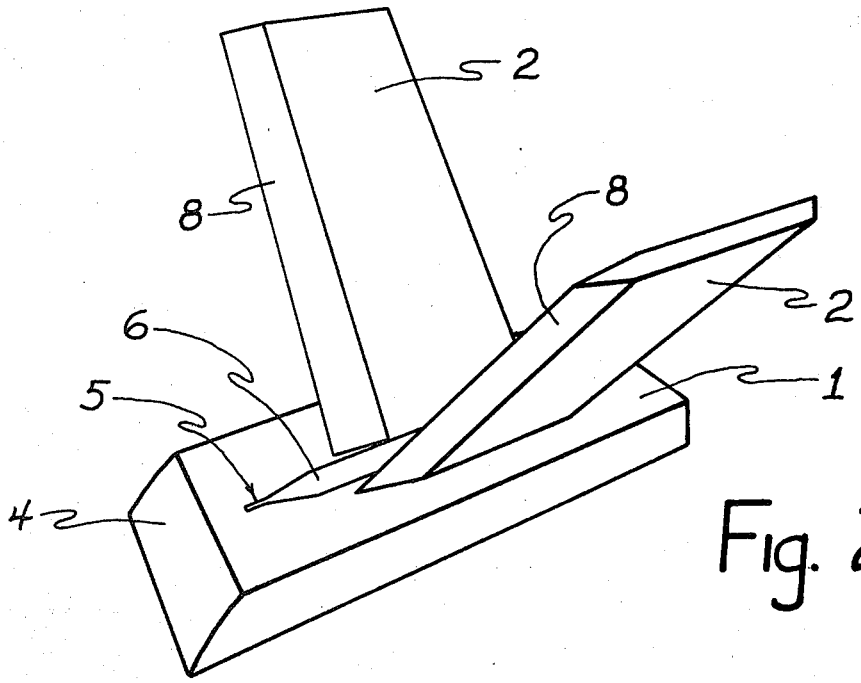
FIG. 2 is a perspective view of the attachment.
Figure 3:
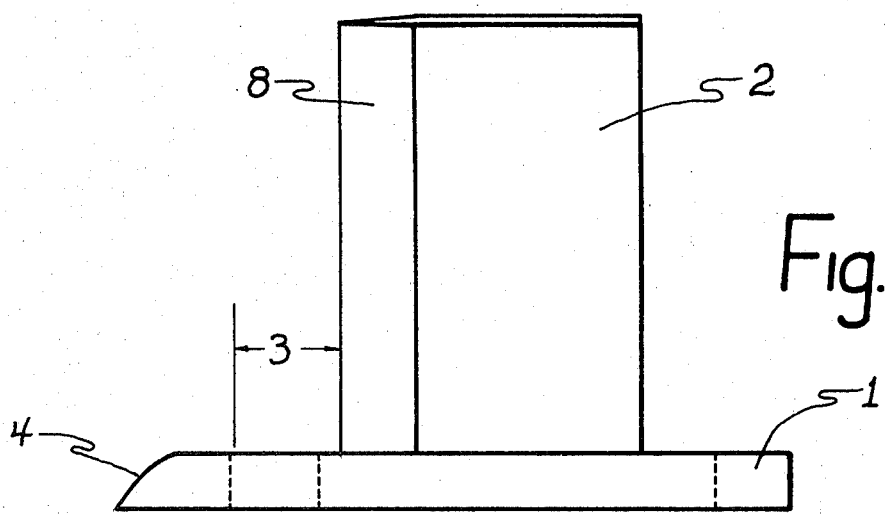
FIG. 3 is a side view of the attachment.
Figure 4:
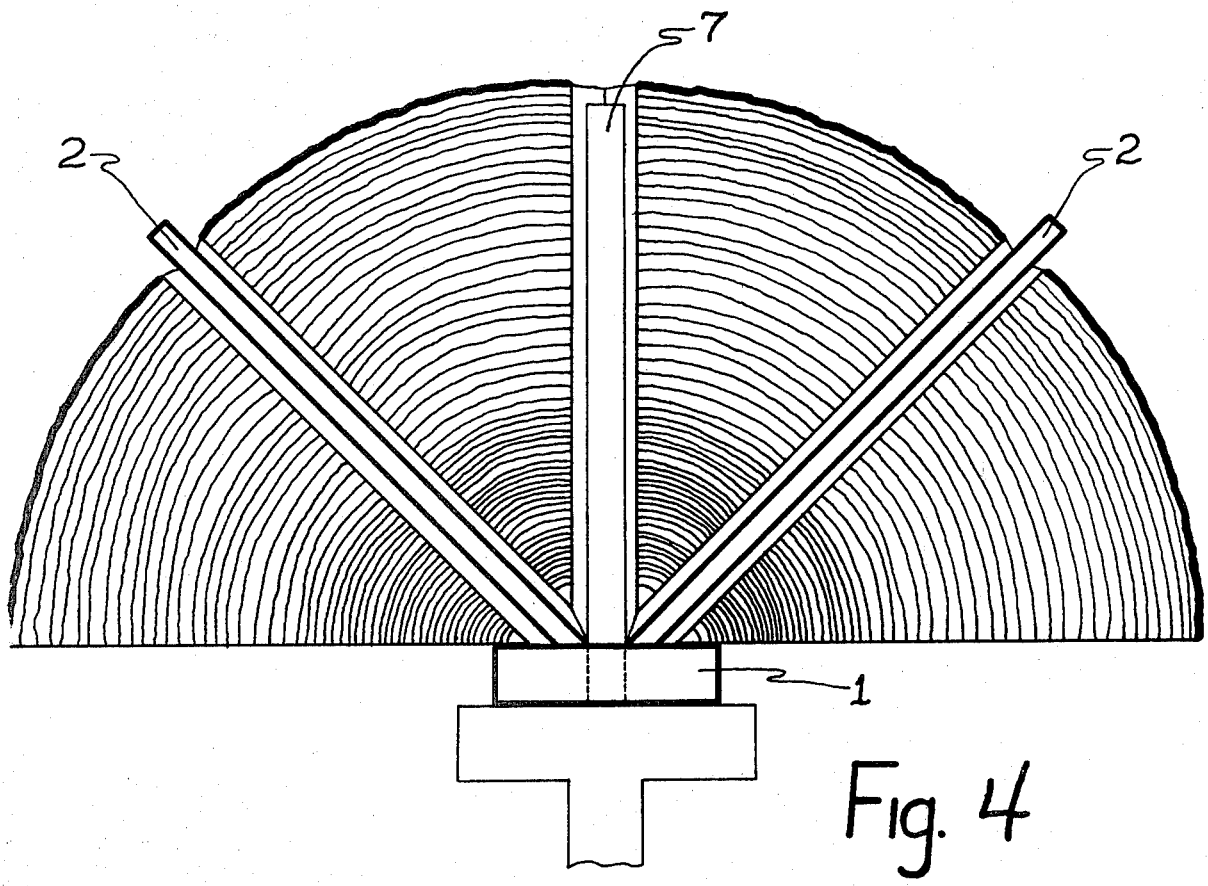
FIG. 4 is a rear view of the attachment in use.

Referring to the drawings, the base 1 is made of steel or some other suitable material. It has an opening 6 in the shape of the fixed wedge 7 of the splitter on which it is to be used. The front end of the opening 5 is enlarged to prevent damage to the sharpened edge of the fixed wedge. The front of the top plane of the base is beveled 4 to prevent binding of the log as it passes through the attachment.

The blades 2 are also made of steel or some other suitable material and are either formed integrally with the base or affixed by a suitable technique such as welding.

The plane formed by the blades are shown at approximately a 45 degree angle to the top of the plane of the base although any angle between 0 degrees and 90 degrees may be used. The leading edge of the blades are double beveled 8 and are set back 3 several centimeters from where the leading edge of the fixed wedge would be located. The leading edges of the blades are parallel to the leading edge of the fixed wedge when viewed from the side.

I claim:

1. A quartering attachment for single fixed wedge log splitters, said fixed wedge of said log splitter having a sharpened leading edge, said quartering attachment consisting of a base, means in said base defining an opening to accomodate said fixed wedge of said log splitter, blade means attached to and extending upwardly from said base forming an acute angle relative thereto, said blade means having sharpened leading edges, said sharpened leading edges facing in the same direction as said fixed wedge.

2. A device as described in claim 1 wherein said means in said base defining an opening is enlarged to accomodate said sharpened leading edge of said fixed wedge of said log splitter.

3. A device as described in claim 1 wherein said blade means are attached to said base so that said sharpened leading edges of said blade means are located behind said sharpened leading edge of said fixed wedge.

4. A device as described in claim 1 wherein said sharpened leading edges of said blade means are double beveled.

5. A device as described in claim 1 wherein the top front edge of said base is beveled.

* * * * *